US005887744A

United States Patent [19]

Mejias

[11] Patent Number: 5,887,744

[45] Date of Patent: Mar. 30, 1999

[54] CLOSURE AND HINGE SYSTEM FOR WASTE-CONTAINING CASES AND IMPLEMENT FOR INSPECTION OPENING

[75] Inventor: David Gonzalez Mejias, Majadahonda, Spain

[73] Assignee: Sanypick, S.A., Daganzo, Spain

[21] Appl. No.: 904,781

[22] Filed: Aug. 1, 1997

[51] Int. Cl.[6] ..... B65D 45/16

[52] U.S. Cl. ..... 220/284; 220/324; 220/786; 220/337; 292/DIG. 17; 81/3.15

[58] Field of Search ..... 220/784, 786, 220/788, 284–286, 908, 315, 324, 326, 334, 337, 340, 341, 343; 292/DIG. 17, DIG. 38, 80, 89; 81/3.55, 3.48, 3.15, 488; 16/231, 232, 297, 319, 321, 324, 325, 326, 334

[56] References Cited

U.S. PATENT DOCUMENTS

| | | | |
|---|---|---|---|
| 3,297,193 | 1/1967 | Stevens . | |
| 3,840,152 | 10/1974 | Hodge | 220/786 X |
| 3,971,488 | 7/1976 | McRoskey et al. | 220/319 X |
| 4,349,120 | 9/1982 | DiNardo . | |
| 4,643,321 | 2/1987 | Gach | 215/252 |
| 5,163,571 | 11/1992 | Morini | 215/252 |
| 5,285,229 | 2/1994 | Kamata | 220/284 X |
| 5,657,893 | 8/1997 | Hitchings | 220/324 X |

FOREIGN PATENT DOCUMENTS

| | | | |
|---|---|---|---|
| 168877 | 1/1986 | European Pat. Off. . | |
| 284509 | 9/1988 | European Pat. Off. . | |
| 326779 | 8/1989 | European Pat. Off. . | |
| 8800325 | 2/1988 | Spain . | |
| 2066479 | 3/1995 | Spain . | |
| 88/05015 | 7/1988 | WIPO | 220/786 |

*Primary Examiner*—Stephen K. Cronin
*Assistant Examiner*—Nathan Newhouse
*Attorney, Agent, or Firm*—Schweitzer Cornman Gross & Bondell LLP

[57] ABSTRACT

A closure for a waste container, which has a lid having a covering surface for covering the mouth of the container, a peripheral first groove in the circumference of the lid, the first groove being open in a direction away from the covering surface and defining an inner peripheral wall having an outer free end, and an outer peripheral wall having an outer free end with peripherally spaced lockable detent projections at the outer free end, the inner and outer peripheral walls being substantially perpendicular to the covering surface, a sealing gasket within the first groove for contacting the mouth when the lid is tightly closed, a lateral extension at the periphery of the lid outwardly of the first groove and forming a second groove in the extension, wherein the second groove being open in a direction that is opposed to the direction of the opening in the first groove, the second groove accommodating a hinge pin attached to the container for attaching the lid to the container mouth, a peripheral lateral extension formed on the container adjacent to its mouth and extending horizontally outwardly therefrom, the extension having an upper and a lower surface, and peripherally spaced openings therein, whereby, upon closing the lid over the container mouth for firmly locking it in place, the peripherally spaced locking detent projections enter the peripherally spaced openings and the detent projections firmly lock the lid in place by the detent projections engaging the lower surface of the horizontal extension.

6 Claims, 4 Drawing Sheets

CLOSURE AND HINGE SYSTEM FOR WASTE-CONTAINING CASES AND IMPLEMENT FOR INSPECTION OPENING

FIELD OF THE INVENTION

The present invention relates to generally to a closure and hinge system for waste-containing containers and particularly the means with which the lid of a case is provided for mounting it in an articulated manner on the mouth of the container, and for sealing the lid. The present invention also relates to an implement permitting disengaging the lid from the body once the case is closed, and the case to be opened when contents have to be inspected.

BACKGROUND

Some waste-containing containers require a sealing system and a closure so that once the lid is closed it can be locked to prevent not only its opening, but also all manipulation that would open the lid.

Containers of this kind are intended to store special kinds of waste, such as sanitary waste from hospitals or other medical sources, which may be contaminating or result in accidents or injuries, for instance syringes, sanitary materials, chemical products used in medicine, and in general waste of any other kind all of which require the container to be sealed, because of bad smell or the risk of contamination or accident, to rule out any chance of the container of the waste being inadvertently opened. European patent No. 168,877 describes a container with a closure with the periphery of its lid being provided with a skirt with outwardly arcuate and resilient deformable grooves at the top mouth of the container, so that as the lid flanges extend beyond the grooves of the container, they are retained due to their resiliency and there is no chance of their opening.

The closure system described in European Patent No. 168,877 does not provide for attachment of the lid enabling it to be opened and not closed until the container is full with waste products. Furthermore, the flanges for locking the lid after it is closed can be manipulated and the lid can be opened by manual resilient deformation.

Although the lid of European patent No. 168,877 can provide a seal, and the closure achieved can be considered as effective against potential attempts to open it, its drawback is that it cannot be movably attached to the container enabling the lid to be opened and closed to insert the waste, before it is closed, nor indeed are there suitable means to preventing manipulation and attempted opening of the lid after it is closed.

SUMMARY OF THE INVENTION

In accordance with the present invention a lid is provided for attaching a lid for certain waste products. In particular the lid is provided with a system hinging it to the waste container, enabling the lid to be opened as many times as desired before it is definitely locked. The hinge system permits the lid to be opened and closed, even if the closure is of a temporary nature, since the lid will fit on the mouth of the case without being closed and locked unless the operator so desires.

In the closure system of the present invention the circumference of the lid has a skirt provided with a pair of extensions arranged parallel to one another and having a deep groove in which a bolt is positioned across the groove and provided in the container, the bolt is arranged between the two brackets that project perpendicularly from the lateral surface of the case, close to its mouth.

The means for mounting and hinging the lid, is provided with a number of flanges formed on the peripheral skirt. The flanges have a sloped projection that allows them to be easily inserted in windows provided in a side of the container, and being locked when the projections extend beyond the grooves, although when they do not extend beyond the grooves, the lid can be opened and closed without being locked.

The peripheral extension in the side of the container contains the grooves for locking the flanges on the peripheral skirt of the lid, has an upward and downward expansion which defines an upright sector perpendicular to the horizontal sector in which the grooves are provided, so that the upright sector constitutes means preventing the insertion of tools that could pry open the lid.

Right above the wing of the container, the wall of the container is substantially weakened on its inner surface as the container is deformed, specifically its mouth is radially contracted as the lid is engaged and until such engagement is definitely achieved. This deformation of the mouth of the container is intermittent, at each of the flanges on the lid, since in addition to an inner weakening of the mouth of the container, strengthening ribs are located on its outside around the grooves on the side wing of the container body.

The present invention also relates to an implement that permits the container to be opened once it has been firmly closed so that it contents be inspected. That implement has a ring of the shape and size of which are matched to the periphery of the body, close to the side wing of the body. The ring has a plurality of teeth, their number and position matching those of the grooves on the side wing, each tooth defining an inner inclined plane to internally deform the flanges on the lid, and inner ledge for it to be axially displaced with respect to the body.

BRIEF DESCRIPTION OF THE DRAWING

In order to provide a fuller description and contribute to the complete understanding of the characteristics of this invention, a drawing is provided, wherein.

DETAILED DISCLOSURE

Figure 1:
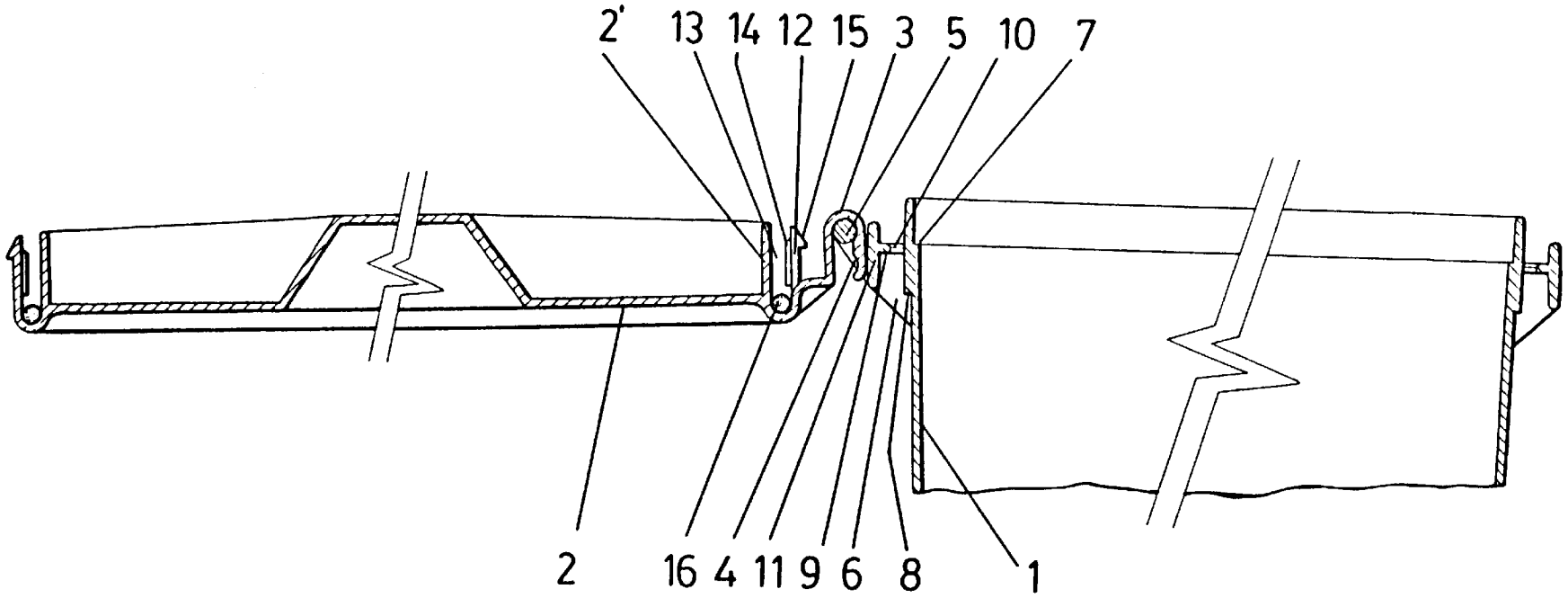
FIG. 1 is a partly side elevational-cross sectional view of the top, namely the mouth, of a container on which the relevant closure lid is mounted in an open position, showing the hinge.

The closure and hinge system of the present invention is applicable to a container 1 for containing certain wastes that must be closed with a lid 2 when its full. The closure should firmly seal the opening of the container so that it cannot be opened by undue manipulation.

The hinge system comprises a pair of lateral extensions 3 on the lid 2, the extensions having a deep groove 4 in which a bolt 5 is positioned, located across both extensions 3 provided on the container 1. The bolt 5 is suitably located, e.g. between a pair of brackets 6 on the side of the container 1. The bolt 5 is arranged close to the mouth of the container 1. That mouth has a pair of ledges 7 and 8. The first ledge 7 is an inner ledge, and the second ledge 8 is an outer ledge, their function to be explained hereinafter.

The lateral surface close to the top edge of the mouth of the container 1 has a extension 9 provided with openings 10. The extension 9 reaching into another extension 11 that is perpendicular thereto. This will result in the extension 11 becoming an outer upright stiffening portion with the extension being an inner horizontal portion where the openings 10 are precisely provided.

Figure 2:
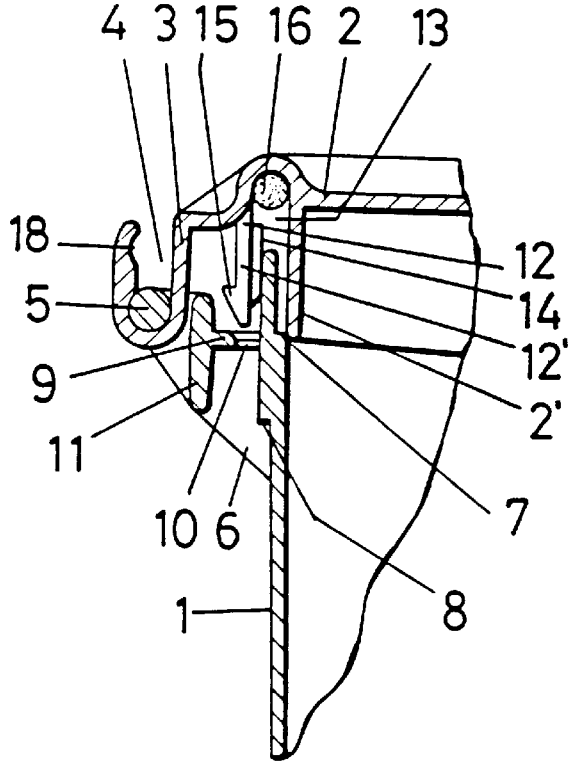
FIG. 2 is a closure view of the lid hinge, with the lid in a non-firmly closed position, i.e. without the flanges provided thereon locked in the corresponding grooves of the body.
Figure 3:
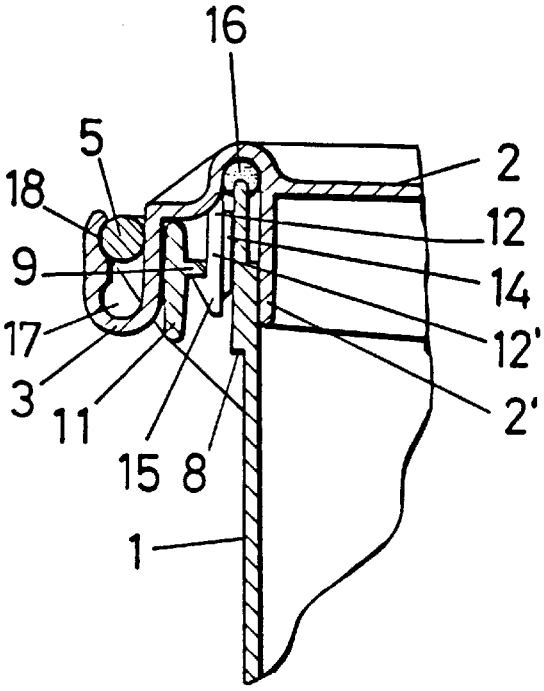
FIG. 3 is a closeup resembling that of FIG. 2, but the lid in its firmly closed position, i.e. with its flanges locked in the grooves provided on the side wing of the container.
Figure 4:
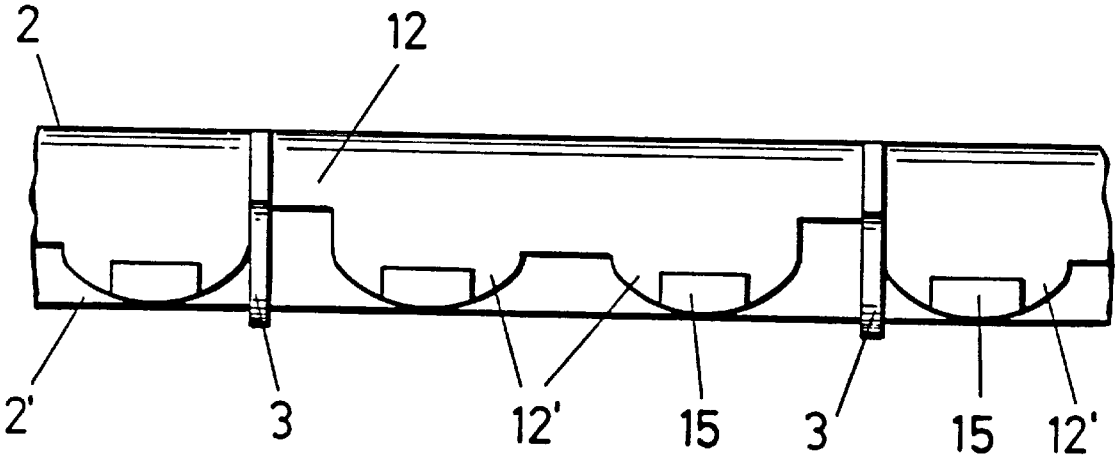
FIG. 4 is a side view of the lid, showing the locking flanges and the two wings constituting the lid hinge to the container.

The lid 2 has a peripheral skirt 12 defining with another inner skirt 2' a groove 13 between the skirts. With the lid 2 closed the groove 13 positions the top of the mouth of the container 1, as shown in FIGS. 2 and 3. The extension 12 has arcuate flanges 12' having a claw-like detent projection 15 and the flanges 12' are provided on their interior with strengthening ribs 14. The detent 15 defines a sloping portion and a hooking ledge to enable insertion and locking of the peripheral extension 9 of the container 1 in the openings 10. A sealing gasket 16 is provided on the bottom of the groove 13.

The arcuate configuration of the edge of the flanges 12' at the ends of the peripheral skirt 12 of the lid brings about a self-centering effect when the lid 2 is closed over the mouth of the container 1.

The deep groove 4 for positioning the bolt 5 that is the hinge pin of the lid 2, has two distinct areas, one between the bottom 17 of the groove 4, and another one being an area 18 close to the opening of the groove 4. Thus a stable mounting is provided for the lid upon being mounted on the bolt or hinge pin (5) in either of the areas 17 and 18, due to their configuration.

In accordance with the characteristics described above, as shown in FIG. 2, the open lid 2 will be located with the bolt 5 being in the deepest area 17 of the groove 4 of lateral extension 3 of the lid 2. This position allows the lid 2 to be mounted and swung over the container 1, and opened and closed without the closed position, as shown in FIG. 2, being firmly established wherein the top of the mouth of the container is only partly positioned in the groove 13 and the detent projections 15 of the flanges 12' will therefore not enter the opening 10 and there will be no locking. Thereby waste can be placed in the container 1 until it is full.

Tight closure of the lid is made when the container 1 is full, or otherwise when desired. In that case from the provisionally closed position shown in FIG. 2, the lid 2 is pushed down, so that the bolt 5 moves up to the position in the area 18 of the groove 4 of the lateral extensions 3 forming part of the hinge system. In this position the flanges 12' on the lid 2 are lowered and the projections or heels 15 will range into the openings 10 and locked by the ledge defined externally on each of the detent projections 15, whereupon the lid 2 becomes firmly closed and cannot be opened, for not even the flanges 12' can be manipulated, since this is prevented by the vertical extension 11 emerging perpendicularly to the horizontal extension 9 in which the opening housing the locking detent 15 are provided.

Figure 5:
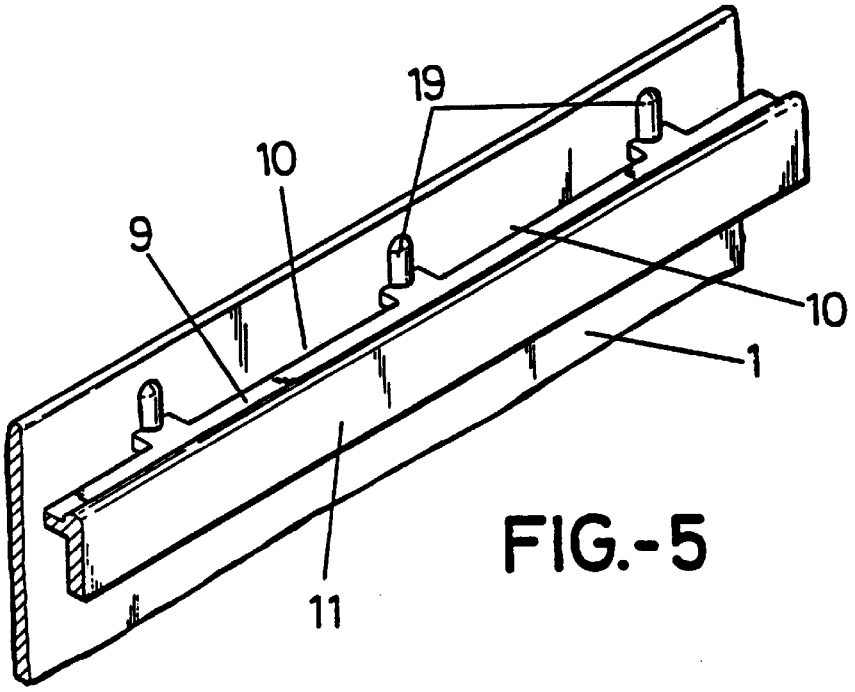
FIG. 5 is a partial perspective closeup of the mouth of the body, showing the strengthening ribs around the areas weakened by the mouth.
Figure 6:
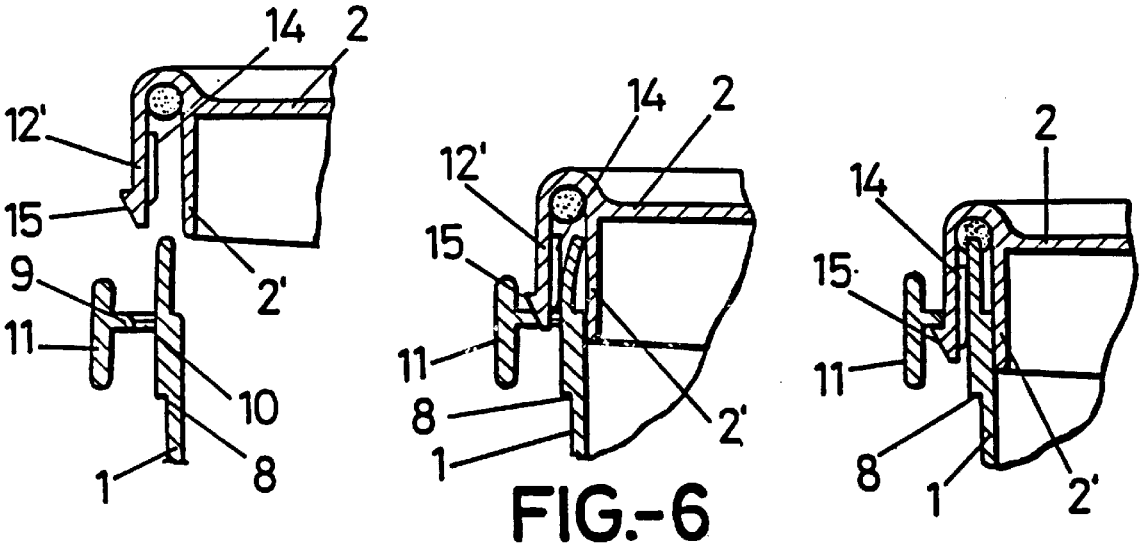
FIG. 6 is a cross-sectional sequence of three various stages of closing the container, showing the resilient deformation and subsequent recovery of the container body shape.

This operation takes place due to a resilient deformation of the mouth of the container body 1, as shown particularly in the operative sequence of FIG. 6, at which the mouth of the container body 1 is weakened above the inner ledge 7 providing thereby for a lesser wall thickness that allows the resilient deformation of the container mouth. This takes place specifically at each of the flanges 12' on the lid, since the mouth of the container body 1 in this weakened sector is stiffened by ribs 19, as can be clearly seen in FIG. 5, around the opening 10.

In its firmly closed position, the top edge of the mouth of the container 1 pushes against the sealing gasket 16 in the bottom of the groove 13, as shown in FIG. 3, thereby establishing a total seal to prevent the exit of smells from the full container.

The double ledge 7 and 8 on the inside and the outside of the container 1, allows the lid to be self-centered in the groove 13, the inner skirt 2 on the lid assisting this, as shown in FIGS. 2 and 3.

Figure 7:
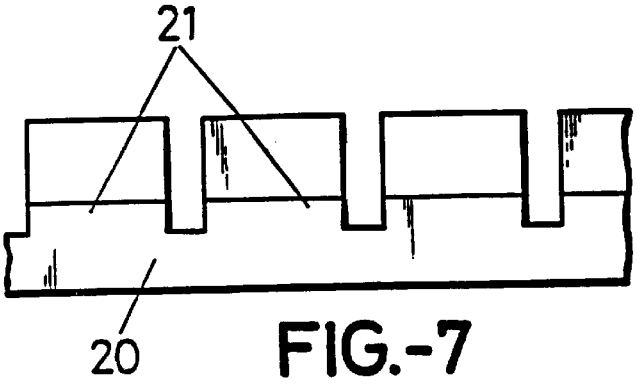
FIG. 7 is a partial side elevational closeup of the opening implement for the container.
Figure 8:
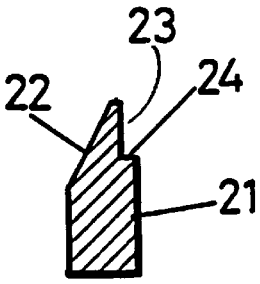
FIG. 8 is a cross-sectional closeup of the implement of FIG. 7.
Figure 9:
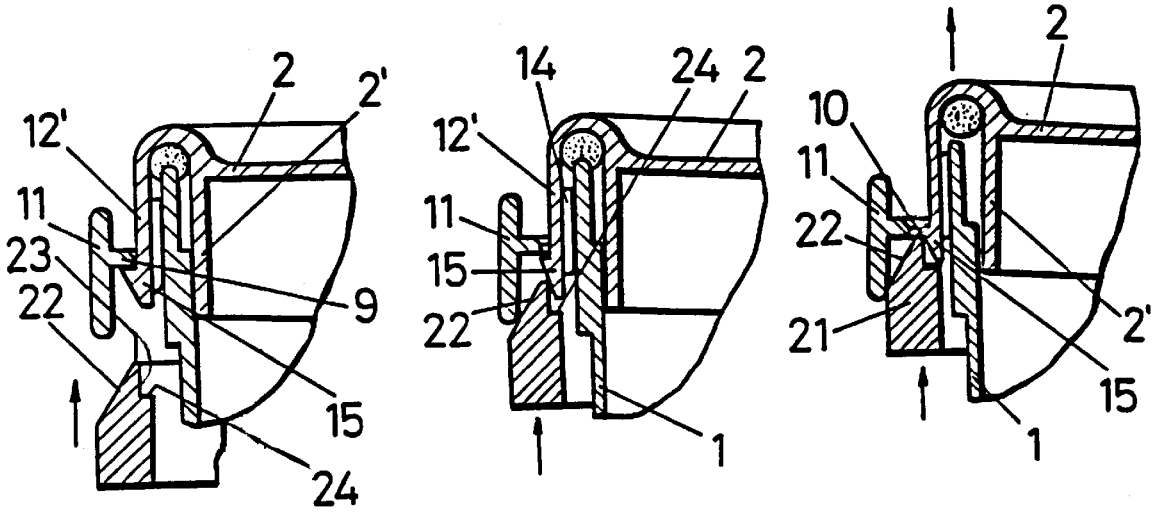
FIG. 9 is the implement of FIG. 7 at the container body deformation stage, for disengaging the lid.

Although the container is designed so that, once it is firmly sealed, it cannot be opened. If its contents should eventually need to be inspected, it may be opened with the assistance of the opener implement shown in FIGS. 7 and 8, which can be made to act as shown in FIG. 9.

The opener implement comprises a ring 20 for receiving therein the container body 1 when the ring 20 is moved axially from the bottom of the container upward towards its mouth. The ring has a plurality of teeth 21, their number and position matching that of the openings 10 where the flanges 12 are locked. Each of said teeth 21 is provided with an outer inclined plane 22 designed to contact the vertical extension 11 at the mouth of the container body 1 to internally deform the flanges 12 and thereby allow the detent projections 15 to be released from the peripheral extensions 9, as the front 23 of the teeth 21 pushes against the inclined plane of the detent 15, pushing them inward, and finally an inner ledge 24 on the teeth 21 pushes the tip of the flanges 12' to disengage the lid from the container body 1.

The materials, shape, size and layout of the elements may be altered provided that this entails no modification of the essential features of the invention, as claimed.

I claim:

1. A closure system for a waste container, which comprises (A) a container body having a mouth defining an edge, and a wall of the container, having an interior surface, and an exterior surface, (B) a lid having a covering surface for covering said mouth, a peripheral first groove in the circumference of said lid, said first groove being open in a direction away from said covering surface and defining (Bi) an inner peripheral wall having an outer free end, and (Bii) an outer peripheral wall having an outer free end with peripherally spaced lockable detent projections at said outer free end thereof, said inner and outer peripheral walls being substantially perpendicular to said covering surface, (C) a sealing gasket within said first groove for having said edge contacting said gasket when said lid is tightly closed over said mouth, (D) a lateral extension at a periphery of said lid outwardly of said first groove and having a second groove in said extension, said second groove being open in a direction that is opposed to the direction of the opening in said first groove, said second groove being provided for accommodating a hinge for attaching the lid to said mouth, said hinge comprising a hinge pin that is attached to the exterior of said container, (E) a peripheral lateral extension formed on said container adjacent to its mouth and extending horizontally outwardly therefrom, said extension having a horizontal extension part ranging outwardly from the exterior surface and terminating in an outer end, and having an upper and a lower surface, and peripherally spaced openings therein, whereby, upon closing the lid over said mouth for firmly locking it in place, said peripherally spaced locking detent projections enter said peripherally spaced openings and said detent projections firmly lock said lid in place by said detent projections engaging said lower surface of said horizontal extension.

2. The closure system of claim 1, wherein said second groove has two lateral interior depressions vertically spaced from one another in a side of the second groove, for accommodating said hinge pin, whereby upon a temporary closing of the lid said hinge pin is moved to one of said depressions, and upon the firmly locked closing of the lid said hinge pin is moved to the other one of said depressions.

3. The closure system of claim 1, further comprising a vertical extension integrally joined at said outer end of and ranging above and below said horizontal peripheral lateral extension for preventing the possibility of prying open said lid when it is firmly closed over said mouth.

4. The closure system of claim 3, wherein an edge portion of said container wall in the vicinity of said mouth is deformable by bending said edge portion toward the interior of the container, and said outer peripheral wall of said first groove has means on its surface facing the interior of said first groove, for temporarily deforming said edge portion during the firm closing of said lid over said container mouth.

5. The closure system of claim 3, further comprising an implement for opening the container when the lid is firmly closed over the container mouth, the implement comprising an annular member of a dimension to fit about a circumference of said waste container body, a plurality of peripherally spaced teeth, said teeth being integral with said annular member, said teeth being of a same number and width as the number and width of said peripherally spaced openings in said horizontally extending peripheral lateral extension, each of said teeth having an end formed for pushing from below against one of said locked detent projections in said outer peripheral wall, whereby upon an upward movement of said implement said lockable detent projections are is deformed by being forced out of engagement with said lower surface of said horizontally extending peripheral lateral extension and said lockable detent projections are becomes released from their locked position to permit easy removal of said lid from over said mouth.

6. The closure system of claim 5, wherein each of said teeth is formed with an outwardly sloping vertical surface for contacting said vertical extension that is below said horizontal lateral extension, for facilitating the release of said detent projections from their locked position.

* * * * *